US012060663B2

(12) United States Patent
Bruske et al.

(10) Patent No.: US 12,060,663 B2
(45) Date of Patent: Aug. 13, 2024

(54) REED COMPRISING A MULTIPLICITY OF SLATS

(71) Applicant: Groz-Beckert KG, Albstadt (DE)

(72) Inventors: Johannes Bruske, Albstadt (DE); Stephen Wohnhas, Meßstetten (DE); Peter Meinert, Balingen (DE)

(73) Assignee: GROZ-BECKERT KG, Albstadt (DE)

( * ) Notice: Subject to any disclaimer, the term of this patent is extended or adjusted under 35 U.S.C. 154(b) by 151 days.

(21) Appl. No.: 17/641,600

(22) PCT Filed: Sep. 8, 2020

(86) PCT No.: PCT/EP2020/075088
§ 371 (c)(1),
(2) Date: Mar. 9, 2022

(87) PCT Pub. No.: WO2021/048131
PCT Pub. Date: Mar. 18, 2021

(65) Prior Publication Data

US 2022/0316107 A1 Oct. 6, 2022

(30) Foreign Application Priority Data

Sep. 10, 2019 (EP) ..... 19196448

(51) Int. Cl.
*D03D 49/62* (2006.01)
*D03D 49/68* (2006.01)

(52) U.S. Cl.
CPC ..... *D03D 49/62* (2013.01)

(58) Field of Classification Search
CPC ..... D03D 49/62; D03D 49/68
See application file for complete search history.

(56) References Cited

U.S. PATENT DOCUMENTS 2,989,088 A * 6/1961 Schmidt ..... D03D 49/62 139/192
3,746,053 A * 7/1973 Crain ..... D03D 49/62 139/192

(Continued)

FOREIGN PATENT DOCUMENTS

CN 1311360 A 9/2001
CN 203475061 U 3/2014

(Continued)

OTHER PUBLICATIONS

International Search Report and Written Opinion dated Nov. 26, 2020, in corresponding International Application No. PCT/EP2020/075088, with English translation (18 pages).

(Continued)

*Primary Examiner* — Robert H Muromoto, Jr.
(74) *Attorney, Agent, or Firm* — Fitch, Even, Tabin & Flannery LLP

(57) ABSTRACT

A reed (16) including multiple slats (20), which are arranged in a transverse direction (Q) at a distance from one another is disclosed. Each slat (20) extends from an upper end (21) to a lower end (22). The upper ends (21) are connected by an adhesive bond to two upper plate parts (32) of an upper holding shaft (23). The lower ends (22) of the slats (20) are connected by an adhesive bond to two lower plate parts (43) of a lower holding shaft (24). The plate parts (32, 43) are each produced from a fiber-reinforced composite material. The entire upper holding shaft (23) and the entire lower holding shaft (24) preferably are made of parts produced from a fiber-reinforced composite material.

15 Claims, 5 Drawing Sheets

(56) References Cited

U.S. PATENT DOCUMENTS

| | | | | | |
|---|---|---|---|---|---|
| 3,754,577 | A * | 8/1973 | Heller | D03C 9/0633 | 139/92 |
| 3,965,940 | A * | 6/1976 | Marty | D03D 49/62 | 139/192 |
| 4,027,702 | A * | 6/1977 | Sherrill | D03D 49/62 | 139/192 |
| 4,458,730 | A * | 7/1984 | Dondi Benelli | D03D 47/3053 | 139/435.6 |
| 4,471,815 | A | 9/1984 | Wagner | | |
| 4,529,014 | A * | 7/1985 | Rast | D03D 47/278 | 139/435.6 |
| 5,046,533 | A * | 9/1991 | Corain | D03D 47/265 | 139/192 |
| 6,408,774 | B1 * | 6/2002 | Meade | D05C 15/38 | 112/80.32 |
| 10,920,344 | B2 * | 2/2021 | Bruske | D03D 49/62 | |
| 2005/0051228 | A1 * | 3/2005 | Bruske | D03C 9/0691 | 139/55.1 |
| 2005/0183467 | A1 * | 8/2005 | Bruske | D04B 27/06 | 66/114 |
| 2006/0102243 | A1 * | 5/2006 | Mettler | D03C 9/0625 | 139/91 |
| 2007/0000552 | A1 * | 1/2007 | Mettler | D03C 9/02 | 139/52 |
| 2007/0144603 | A1 * | 6/2007 | Mettler | D03C 9/02 | 139/52 |
| 2009/0065088 | A1 * | 3/2009 | Mettler | D03C 9/0666 | 139/92 |
| 2010/0101679 | A1 * | 4/2010 | Bruske | D03J 1/223 | 139/304 |
| 2011/0062626 | A1 * | 3/2011 | Kuhl | D04H 3/147 | 264/258 |
| 2011/0265905 | A1 * | 11/2011 | Kuhl | D03D 41/004 | 139/55.1 |
| 2012/0305124 | A1 * | 12/2012 | Gerth | D03C 7/00 | 139/54 |
| 2015/0126089 | A1 * | 5/2015 | Bischoff | D03D 13/006 | 28/165 |
| 2018/0057980 | A1 * | 3/2018 | Bruske | D03D 49/62 | |
| 2019/0002345 | A1 * | 1/2019 | Bruske | B29C 70/845 | |
| 2020/0299874 | A1 * | 9/2020 | Bruske | D03D 49/68 | |
| 2022/0316107 | A1 * | 10/2022 | Bruske | D03D 49/68 | |

FOREIGN PATENT DOCUMENTS

| | | | | |
|---|---|---|---|---|
| DE | 102006061376 | A1 | 6/2008 | |
| EP | 0550752 | A1 | 7/1993 | |
| EP | 1170409 | B1 | 12/2004 | |
| EP | 3425095 | A1 | 1/2019 | |
| GB | 339588 | A | 6/1960 | |
| GB | 2205113 | A * | 11/1988 | D03D 49/68 |
| JP | 2002-138348 | A | 5/2002 | |
| JP | 2011-122275 | A | 6/2011 | |
| JP | 5364554 | B2 | 12/2013 | |
| JP | 2020526677 | A | 8/2020 | |
| RU | 8707 | U1 | 12/1998 | |
| WO | 2016181440 | A1 | 11/2016 | |

OTHER PUBLICATIONS

Extended European Search Report dated Feb. 18, 2020, in corresponding European Application No. 19195448.5, with machine English translation (20 pages).

European Patent Office Communication for EP Application No. 19 196 448.5-1017, dated Sep. 14, 2023; 102 pages.

Federal Institute of Industrial Property (FIPS); Office Action and Search Report in corresponding Russian Patent Application No. PCT/EP2020/075088 mailed Dec. 21, 2023; 12 pages.

China State Intellectual Property Office; Rejection Decision in corresponding Chinese Patent Application No. 202080063227.4, dated Mar. 1, 2024; 22 pages.

Yaoling, et al.; "Foreign Textile Equipment", Textile Industry Press, Bejing, China; May 1982; pp. 270-271.

Wang, et al.; "Polymer Nanocomposites", Northwestern Polytechnical University Press; Aug. 2017; pp. 17-18.

Japan Patent Office; Notice of Reasons for Refusal in corresponding Japanese Patent Application No. 2022-51580 dated Apr. 19, 2024; 10 pages.

Japan Patent Office; Search Report in corresponding Japanese Patent Application No. 2022-51580 dated Apr. 5, 2024; 17 pages.

* cited by examiner

REED COMPRISING A MULTIPLICITY OF SLATS

CROSS REFERENCE TO RELATED APPLICATIONS

This patent application is the national phase of PCT/EP2020/075088, filed Sep. 8, 2020, which claims the benefit of European Patent Application No. 19196448.5, filed Sep. 10, 2019.

TECHNICAL FIELD

Two directly adjacent slats of the reed limit an interstice through which one warp thread is guided respectively. The distance and the orientation of the slats are of importance in order to obtain a uniform woven fabric.

BACKGROUND

A reed is known from U.S. Pat. No. 4,529,014 A in which the end sections of the slats are configured thicker compared with the working section in between, such that the slats can abut against one another in the end sections. The end sections comprise a through-hole and are pushed on a holding rail. In the end sections the slats can be connected to each other by means of an adhesive bond using adhesive.

Due to the applying and hardening of adhesive and the forces created thereby, it can happen that the reed deforms during manufacturing. Such a deformation is undesired.

EP 0 550 752 A1 discloses a reed for a high-speed weaving machine. A DLC-coating is applied on the slats of the reed. The abbreviation DLC thereby means "Diamond Like Carbon". In doing so, the wear of the slats shall be reduced and the lifetime shall be increased.

EP 1 170 409 B1 describes a reed for a weaving machine that shall operate in a noiseless manner. It comprises a box form with which an inner section is connected. Metallic material or a composite material can be used as material.

DE 10 2006 061 376 A1 describes a back rest for a weaving machine having a thread deflection element that is supported at multiple locations in order to configure the thread deflection element with low mass to keep the mass of the parts of the back rest that are able to oscillate as small as possible. The thread deflection element can be manufactured from a low-weight plastic or a fiber-reinforced composite material.

Starting from the known prior art it is an object of the present invention to provide a reed for a weaving machine in which a uniform arrangement and orientation of the slats of the reed is achieved.

SUMMARY

This object is solved by means of a reed having the features as described herein.

The reed has multiple slats that extend in an extension direction between a top end and an opposite bottom end. In a transverse direction that is orientated orthogonal to the extension direction the slats are arranged with distance to one another. Two directly adjacent slats limit an interstice. Through this interstice one warp thread can be guided through respectively during weaving.

The top end of each slat is attached to a top holding shaft. The bottom end of each slat is attached to a bottom holding shaft. The attachment of the slats with the holding shaft is realized by means of an adhesive bond by using an adhesive.

Thereby the slats are connected with each other at the ends and with the respectively assigned holding shaft.

Each holding shaft has two plate parts extending in transverse direction that are not directly in abutment with one another. The plate parts are arranged with distance to one another in a length direction on opposite sides of the top ends of the slats or the bottom ends of the slats respectively. Between two plate parts of the top holding shaft thus the top ends of the slats are held respectively and between two plate parts of the bottom holding shaft the bottom ends of the slats are held respectively. The longitudinal direction is orientated orthogonal to the transverse direction and orthogonal to the extension direction.

In order to be able to align the slats in transverse direction as precisely as possible along a line, the plate parts are manufactured from a fiber-reinforced composite material. As reinforcement fibers carbon fibers and/or glass fibers and/or other plastic and/or natural fibers can be used that are embedded in a plastic matrix of the composite material. It has shown that thereby the manufacturing of the adhesive bond with the adhesive under maintenance of an orientation of the slats and holding shafts along a respective straight line parallel to the transverse direction Q is guaranteed. The plate parts made from composite material are not subject to any or subject to a remarkably lower warping during manufacturing of the reed, particularly during hardening of the adhesive, such that the straightness is remarkably improved compared with plate parts or holding shafts made of other materials, e.g. metallic materials. Concurrently the mass of the holding shafts or the plate parts can be reduced remarkably, which simplifies the acceleration of the reed during striking against the selvedge.

It is advantageous, if the plate parts extend in transverse direction continuously along all of the slats of the reed. The plate parts extend substantially along the entire width of the reed in transverse direction Q and are in transverse direction Q integrally formed without seam or joint. Parallel to the extension direction also multiple plate parts can be arranged adjacent to one another in the top holding shaft and/or the bottom holding shaft. It is, however, preferred if in the top holding shaft as well as in the bottom holding shaft exactly two plate parts are present respectively that form a plate part pair.

It is preferred, if the top holding shaft comprises a cover part that is arranged in extension direction adjacent to the upper end of the slats. The cover part can be directly or indirectly in contact with the two plate parts. The cover part of the top holding shaft can be connected with the top ends of the slats and the plate parts of the top holding shaft by means of an adhesive bond with the adhesive. Preferably the cover part consists of a fiber-reinforced composite material and can be manufactured from the same material as the plate parts. Together with the plate parts a cover part can limit a space that is rectangular or square in cross-section in that the upper ends of the slats can be located in order to establish the adhesive bond with the adhesive.

Preferably the cover part extends in transverse direction continuously along all of the slats. The cover part is integrally formed in transverse direction without seam or joint. Preferably the top holding shaft comprises exactly one cover part.

The bottom holding shaft can comprise a reinforcement rod and particularly a square reinforcement rod that is arranged adjacent to the bottom ends of the slats in extension direction. The square reinforcement rod is arranged between the plate parts of the bottom holding shaft. It is preferably connected with the bottom ends of the slats and the plate parts of the bottom holding shaft by means of the adhesive bond with the adhesive. Particularly the square reinforcement rod extends in transverse direction continuously along all of the slats of the reed. It is integrally formed in transverse direction without seam or joint. Preferably the bottom holding shaft comprises exactly one reinforcement rod.

The slats can be connected with one another by means of a connection arrangement at the top holding shaft and/or at the bottom holding shaft. The connection arrangement serves particularly to connect the slats with one another during the manufacturing of the reed for simplified handling until the adhesive for establishment of the adhesive bond is hardened. In a preferred embodiment the connection arrangement comprises two connection rods extending in transverse direction at the top holding shaft and/or the bottom holding shaft respectively. Each connection rod can be configured as semi-circle rod having a semi-circle cross-section. The connection rods are connected with one another by means of a bendable binding element, e.g. a metallic wire. The binding element can form multiple loops for this purpose. Each loop is guided around the connection rods and through the interstice at an interstice between two slats.

Each connection arrangement comprising two connection rods and the bendable binding element is preferably arranged between the plate parts of the top holding shaft or the plate parts of the bottom holding shaft. Thereby it is particularly advantageous, if each connection rod is arranged with view in longitudinal direction between the slats and the directly adjacent plate part of the respective top holding shaft or bottom holding shaft. For this purpose a cavity extending in transverse direction can be provided in each plate part of the top holding shaft and/or the bottom holding shaft for location of one connection rod respectively. The cavity is open on the side facing the slats and particularly groove-shaped or trough-shaped. The cross-section shape of the cavity corresponds preferably to the cross-section shape of the connection rod to be located therein. For example, a cavity being semi-circular in cross-section can be provided for location of a connection rod being semi-circular in cross-section.

By means of a cavity the plate part can be arranged very close to the respective top ends or bottom ends of the slats. Due to covering the connection rods by means of the plate parts, a separate adhesive joint for covering the connection rods can be omitted. The connection rods are fixed by means of the adhesive bond that is anyway used for connection of the plate parts with the respective adjacent ends of the slats.

In a preferred embodiment at least one spacer is arranged in the region of the top holding shaft and/or at least one spacer is arranged in the region of the bottom holding shaft. Each spacer comprises multiple spacer elements that are arranged in one interstice between two directly adjacent slats respectively.

In an embodiment each spacer can be realized by one helical spring having multiple windings respectively. Thereby one single winding can form a spacer element and can be arranged in the interstice between two directly adjacent slats. The helical spring is preferably arranged under tension.

It is advantageous, if the at least one spacer is arranged between the plate parts of the top holding shaft or the plate parts of the bottom holding shaft in longitudinal direction. The at least one spacer is thus covered by the plate parts and preferably fixed by means of the adhesive bond with the adhesive.

In an embodiment multiple or all of the slats comprise spacer studs. The spacer studs can be arranged on a slat in the range of the top holding shaft and/or the bottom holding shaft. The spacer studs project in transverse direction away from the slat. They can serve to guarantee a minimum distance between two directly adjacent slats. The spacer studs can be present on all of or only on some of the slats.

BRIEF DESCRIPTION OF THE DRAWINGS

Preferred embodiments of the reed are derived from the dependent claims, the description and the drawings. In the following, preferred embodiments of the reed are explained in detail based on the attached drawings. The drawings show:

DETAILED DESCRIPTION

Figure 1:
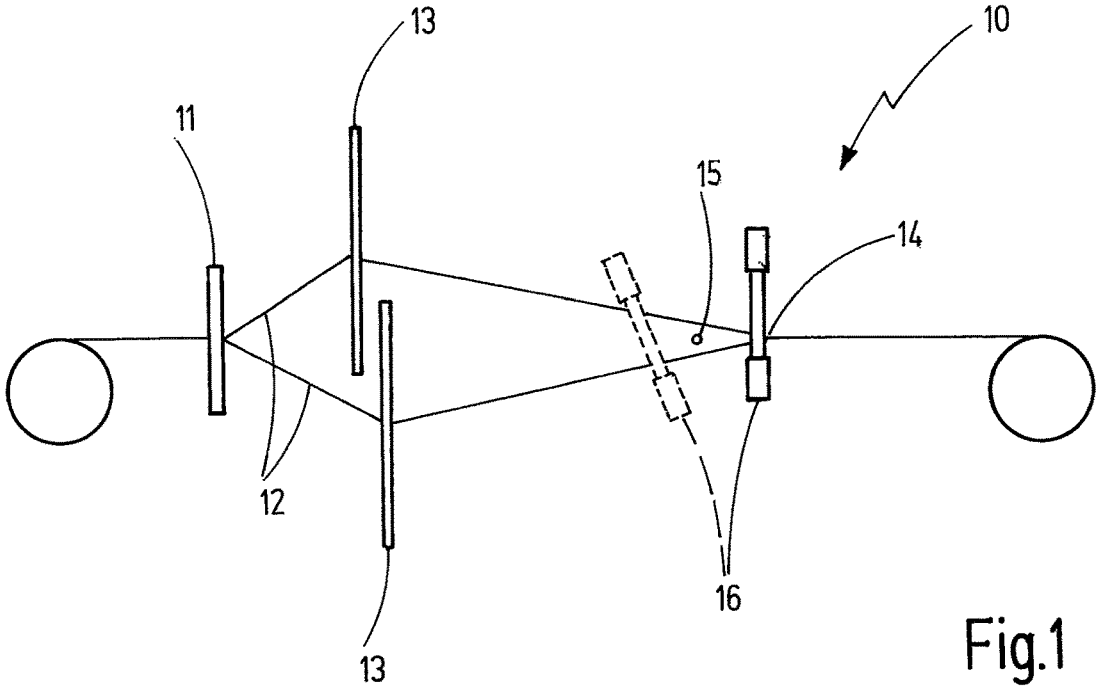
FIG. 1 a block-diagram like basic illustration of a configuration of a weaving machine comprising a reed, FIG. 2 a highly schematic front view of a reed for a weaving machine, FIG. 3 a side view of a slat curved in transverse direction, FIG. 4 a top view on the reed of FIG. 3 from the top, FIG. 5 a section of a slat of a reed in a schematic cross-sectional illustration in a range in which a spacer stud is formed, FIG. 6 a schematic sectional illustration through a reed according to the prior art, FIG. 7 a schematic sectional illustration through a reed of an embodiment according to the invention, FIG. 8 an enlarged illustration of the range A of the reed of FIG. 7 and FIG. 9 a schematic sectional illustration of a further embodiment of a reed according to the invention having a modified embodiment of one or more slats comprising spacer studs.
Figure 2:
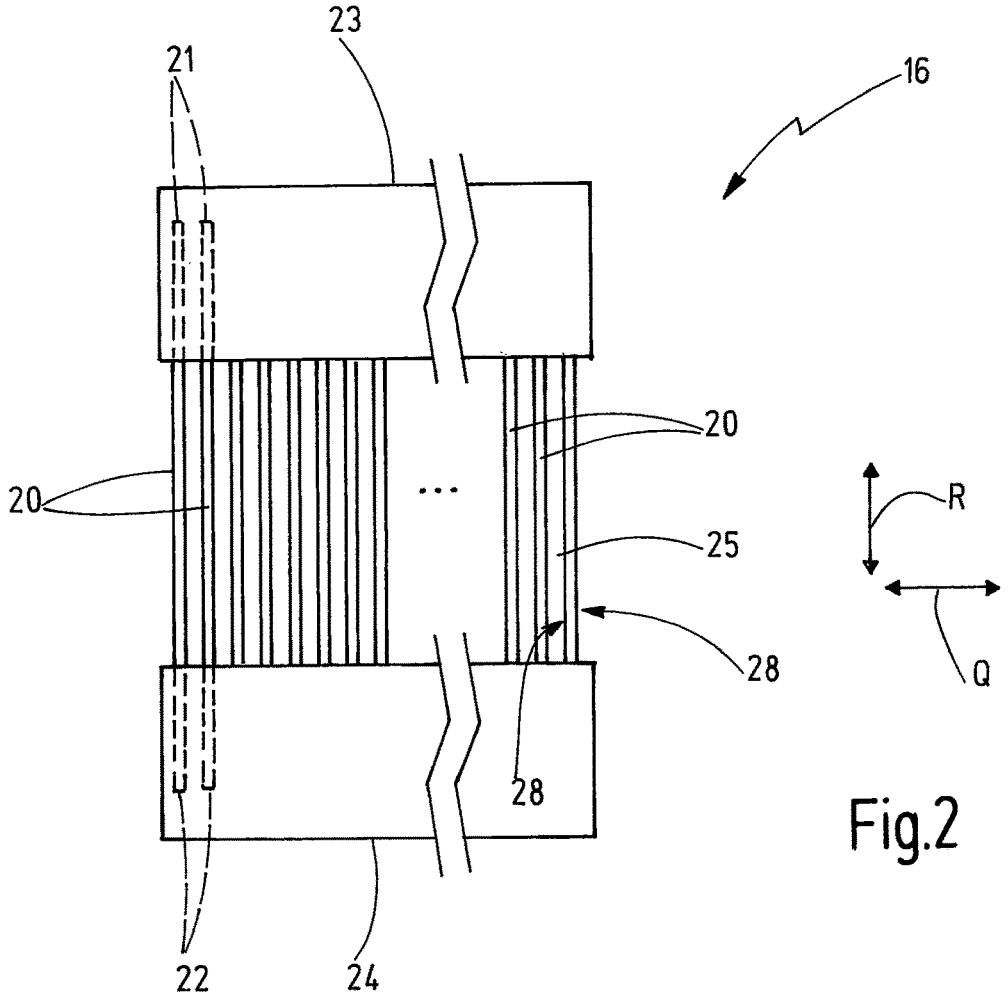

In FIG. 1 the configuration of a weaving machine 10 is schematically illustrated. Starting from a back rest 11, warp threads 12 extend through a not illustrated heddle respectively in one of multiple heald shafts 13. The heald shafts 13 can be moved vertically upward or downward for shed formation. On the warp thread exit side of the heald shafts 13 the warp threads 12 extend up to a selvedge 14. In the shed opened by the heald shafts 13 a weft thread 15 can be inserted in front of the selvedge 14. By means of a reed 16 the inserted weft thread 15 can be struck against the selvedge 14. For this purpose the reed 16 can be moved and particularly pivoted in order to strike against the selvedge 14. The strike position of the reed 16 is illustrated in FIG. 1 with a continuous line, whereas a retraction position of the reed 16 distant to the selvedge 14 is illustrated in dashed lines.

The reed 16 comprises a multiplicity of slats 20. Each slat 20 extends in an extension direction R from a top end 21 to a bottom end 22. The top ends 21 of the slats 20 are attached to a top holding shaft 23, whereas the bottom ends 22 are attached to a bottom holding shaft 24. In a transverse direction Q orthogonal to the extension direction R the slats 20 are arranged uniformly with distance to one another, whereby two directly adjacent slats 20 limit an interstice 25. A warp thread 12 can be guided through an interstice 25. The transverse direction Q corresponds substantially to the weft thread direction in which the weft thread 15 is inserted into the shed. At least in the strike position during striking at the selvedge 14 the extension direction R of the slats 20 can be orientated approximately vertically. As for example apparent from FIG. 3, each slat has a front edge 26 and a back edge 27 opposite the front edge 26 in a longitudinal direction L. The longitudinal direction L is orientated orthogonal to the extension direction R and orthogonal to the transverse direction Q. Each slat 20 has two lateral surfaces 28 that are present on opposite sides in transverse direction Q. The lateral surfaces 28 of two directly adjacent slats 20 limit the interstice 25.

In an embodiment front edge 26 and back edge 27 of each slat 20 extend parallel to each other and can have a straight extension, for example. As an alternative to this, the front edge 26 and/or the back edge 27 can extend non-linearly. For example, a depression can be present at a location on each front edge 26 for forming an air channel extending in transverse direction Q. The air channel can allow the introduction of a weft thread by means of air nozzles.

Figure 3:
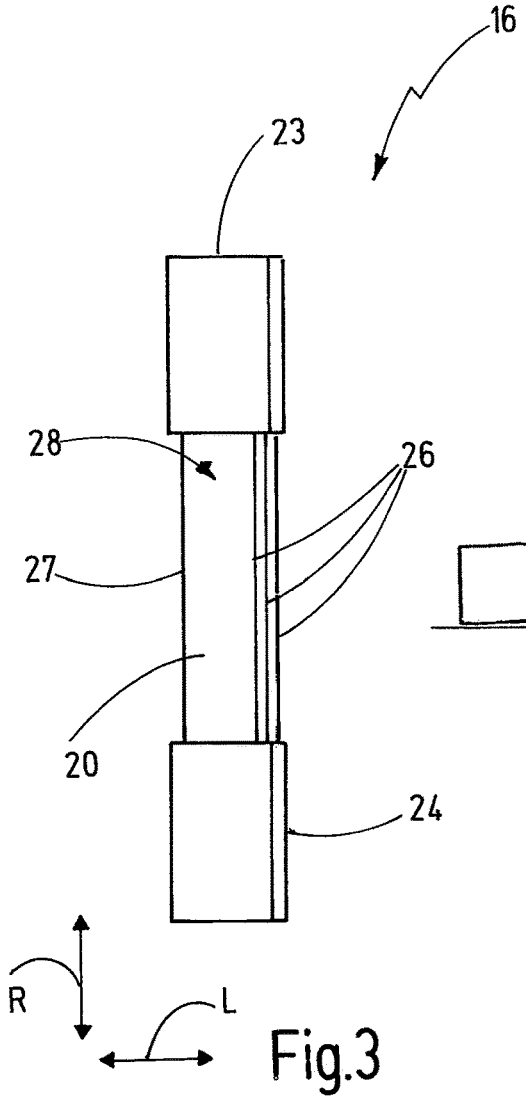
Figure 4:
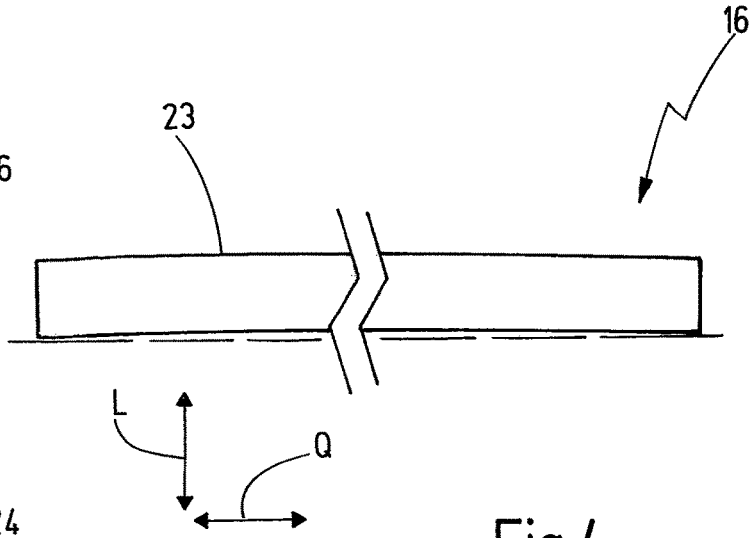

In order to obtain a uniform woven fabric, it is important that the distance of the slats 20 in transverse direction Q and thus the width of the interstices 25 has the same dimension everywhere on one hand and that the front edges 26—at least outside of the optionally present depression at the front edges 26 for forming an air channel—are located in a common plane on the other hand that is orientated orthogonal to the longitudinal direction. It is schematically illustrated in FIGS. 3 and 4 that a curvature or irregular deformation of the top holding shaft 23 and/or the bottom holding shaft 24 can occur during manufacturing of the reed 16, particularly due to an adhesive bond created by means of adhesive between the holding shafts 23, 24 and the slats 20 and thereby the front edges 26 are no longer located in one single common plane.

An undesired deformation of the holding shafts 23, 24, as it can occur in the prior art, shall be avoided.

Figure 7:
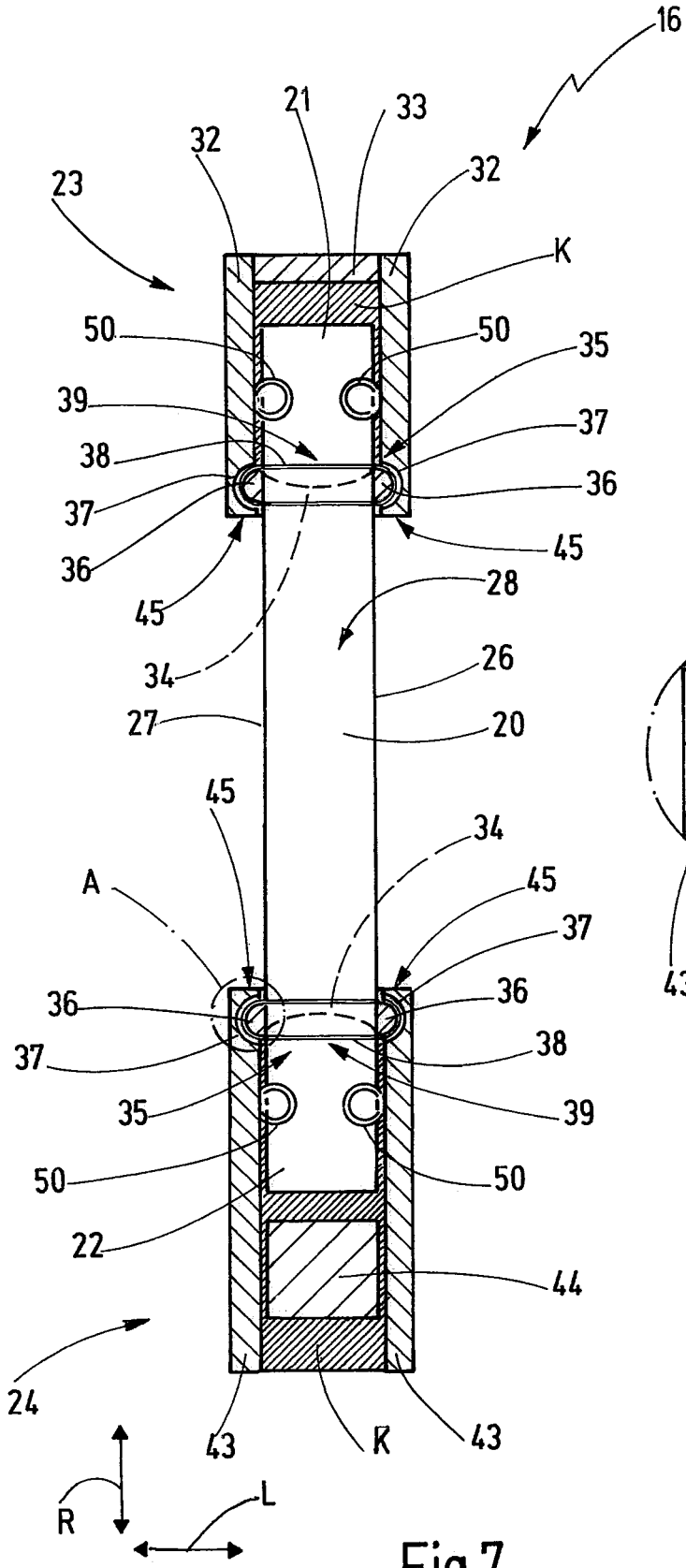

In FIG. 7 a sectional illustration through a reed 16 is shown according to an embodiment according to the invention. The top holding shaft 23 comprises two top plate parts 32 that are arranged with distance to one another in longitudinal direction L and locate the top ends 21 of slats 20 therebetween. The top plate parts 32 extend in transverse direction Q along all of the upper ends 21 of slats 20 and are configured integrally without seam or joint respectively. The top plate parts 32 consist of a fiber-reinforced composite material. The reinforcement fibers can be carbon fibers or glass fibers that are embedded in a plastic matrix.

In the embodiment the top holding shaft 23 further comprises a cover part 33. Also the cover part 33 preferably consists of a fiber-reinforced composite material and for example of the same material as the top plate parts 32. The cover part 33 is arranged in extension direction R adjacent to the top ends 21 of slats 20. The cover part 33 extends in transverse direction Q preferably along all of the top ends 21 of slat 20 and is configured integrally without seam or joint. The cover part 33 and the two top plate parts 32 limit a space rectangular in cross-section for receiving an adhesive K. By means of adhesive K the top ends 21 of slats 20 the top plate parts 32 and the cover part 33 are connected with one another by adhesive bond. In the region of the top ends 21 the adhesive K also enters between the slats 20 and forms a terminal surface 34 on the side opposite the cover part 33 that extends convexly domed outward. The terminal surface 34 can be arranged in the region between the top plate parts 32 and preferably does not project in extension direction R out of the region between the top plate parts 32.

In order to guarantee the position and orientation of the slats 20 relative to one another prior to hardening the adhesive K, a connection arrangement 35 is present on the top ends 21 of slats 20. Two connection rods 36 extending parallel to one another in transverse direction Q are part of the connection arrangement 35. In the embodiment each connection rod 36 is configured as semi-circle rod having a semi-circular cross-section. The one connection rod 36 abuts against the front edges 26 and the respective other connection rod 36 abuts against the back edges 27 of the top ends 21 of slats 20. For each connection rod 36 a cavity 37 is introduced into the adjacent top plate part 32 that is open toward the front edges 26 or back edges 27 of slats 20. The cavities 37 and the top plate part 32 are groove-shaped. In cross-section the cavities 37 are adapted to the shape of the connection rod 36 located therein and are also configured in a semi-circular manner in the embodiment.

A bendable binding element 38 is also part of the connection arrangement 35, e.g. a wire made of metallic material. The binding element 38 connects the connection rods 36 of the connection arrangement 35 under formation of multiple loops 39. Exactly one or at least one loop 39 is respectively guided around the two connection rods 36 and through one interstice 25 between two directly adjacent slats 20. In doing so, at least a preliminary connection and fixation of the slats 20 is created.

The bottom holding shaft 24 of reed 16 comprises two bottom plate parts 43 arranged with distance to one another in longitudinal direction L analog to the top holding shaft 23 that locate the bottom ends 22 of slats 20 therebetween and extend in transverse direction Q along all of the bottom ends 22 of slats 20. The bottom plate parts 43 are configured integrally without seam or joint and consist—analog to the top plate parts 32—of a fiber-reinforced composite material. The dimension of the bottom plate parts 43 in extension direction R can be different from the dimension of the top plate parts 32 in extension direction R.

Instead of the cover part 33 the bottom holding shaft 24 comprises a reinforcement rod 44 that is configured as square rod in the embodiment. The reinforcement rod 44 extends in transverse direction Q along all of the bottom ends 22 of slats 20 and is arranged adjacent to the bottom ends 22 in extension direction R. The reinforcement rod 44 is arranged between the bottom plate parts 43 with view in longitudinal direction L. By means of an adhesive K introduced between the bottom plate parts 43, the bottom plate parts 43, the reinforcement rod 44 as well as the bottom ends 22 of slats 20 are connected with one another by means of an adhesive bond. On the edges facing the top holding shaft 23 of the bottom plate parts 43 the adhesive K also forms a terminal surface 34.

In the region of the bottom holding shaft 24 also a connection arrangement 35 for connecting the slats 20 is present that has the same configuration as the connection arrangement 35 at the top holding shaft 23. The bottom plate parts 43 have a cavity 37 for locating a connection rod 36 of the connection arrangement 35 therein respectively, in accordance with the top plate part 32. For the detailed arrangement and configuration of the connection arrangement 35 in the region of the bottom holding shaft 24 or the bottom ends 22 reference can be made to the description of the connection arrangement 35 at the top holding shaft 23.

The plate parts 32, 43 terminate approximately with the respectively provided connection arrangement 35 on the sides facing each other. The plate parts 32 extend beyond the connection arrangements 35 only slightly toward the respective other holding shaft 24 or 23. Each plate part 32, 43 of a holding shaft 23 or 24 has a face 45 that faces the respective other holding shaft 24 or 23 in extension direction R. For example, a face 45 of a bottom plate part 43 is arranged opposite a face 45 of a top plate part 32 in extension direction R.

The cavities 37 in the plate parts 32, 43 are arranged nearby a face 45 of the respective plate part 32, 43 respectively. Between the face 45 and the cavity 37 the respective plate part 32, 43 has a web surface 46, the height H in extension direction R thereof is small. The web surface 46 faces the front edges 26 or the back edges 27 of slats 20 depending on the position of the plate part 32, 43. The height H of the web surface 46 is at most 2 mm or at most 3 mm in the embodiment.

In the embodiment the adhesive K that is in contact with the two top plate parts 32 or the two bottom plate parts 43 can form convexly outward domed terminal surfaces 34 between the opposite plate parts 32, 43. In doing so, the formation of larger pocket-like depressions is avoided in which fibers and other contaminations may accumulate.

Figure 8:
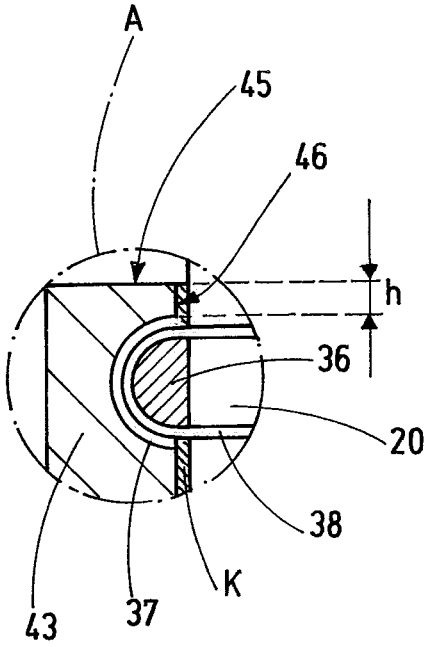

The region A marked in FIG. 7 is illustrated in FIG. 8 in an enlarged manner. The height H of a web surface 46 is illustrated by way of example of a bottom plate part 43. The configuration applies for all of the plate parts 32, 43 of the reed 16 similarly.

In the embodiment illustrated in FIG. 7, respectively at least one spacer 50 and according to the example, two spacers 50 are arranged on the top ends 21 between the two top plate parts 32 as well as on the bottom ends 22 between the bottom plate parts 43. Each spacer 50 has multiple spacer elements, wherein respectively one spacer element is arranged in the interstice 25 between two directly adjacent slats 20. In the embodiment each spacer 50 is a helical spring, wherein exactly one winding of the helical spring is a spacer element. The helical springs can be arranged under tension on the top ends 21 and the bottom ends 22 of slats 20. The wires of the helical springs can pass in an adhesive joint between the front edges 26 and the adjacent plate parts 32, 43 or the back edges 27 and the adjacent plate parts 32, 43. The strength of the wire of the helical spring is usually slightly smaller than the interstice 25 and can be at most 35 μm and according to the example, 20 μm in filigree reeds 16. In coarser reeds also larger wire strengths are possible. For these small wire strengths of helical springs it is not necessary to provide a cavity at the front edges 26 or back edges 27 of slats 20 or plate parts 32, 43.

As illustrated, the separate spacers 50 are arranged with view in longitudinal direction L between the top plate parts 32 of top holding shaft 23 or bottom plate parts 43 of bottom holding shaft 24 respectively and are integrated in the later produced adhesive bond by means of adhesive K.

Figure 5:
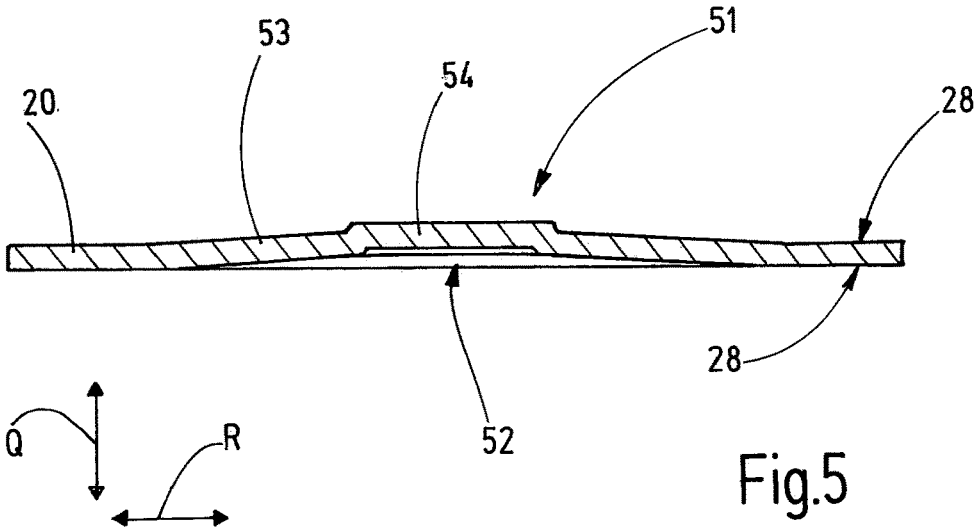
Figure 9:
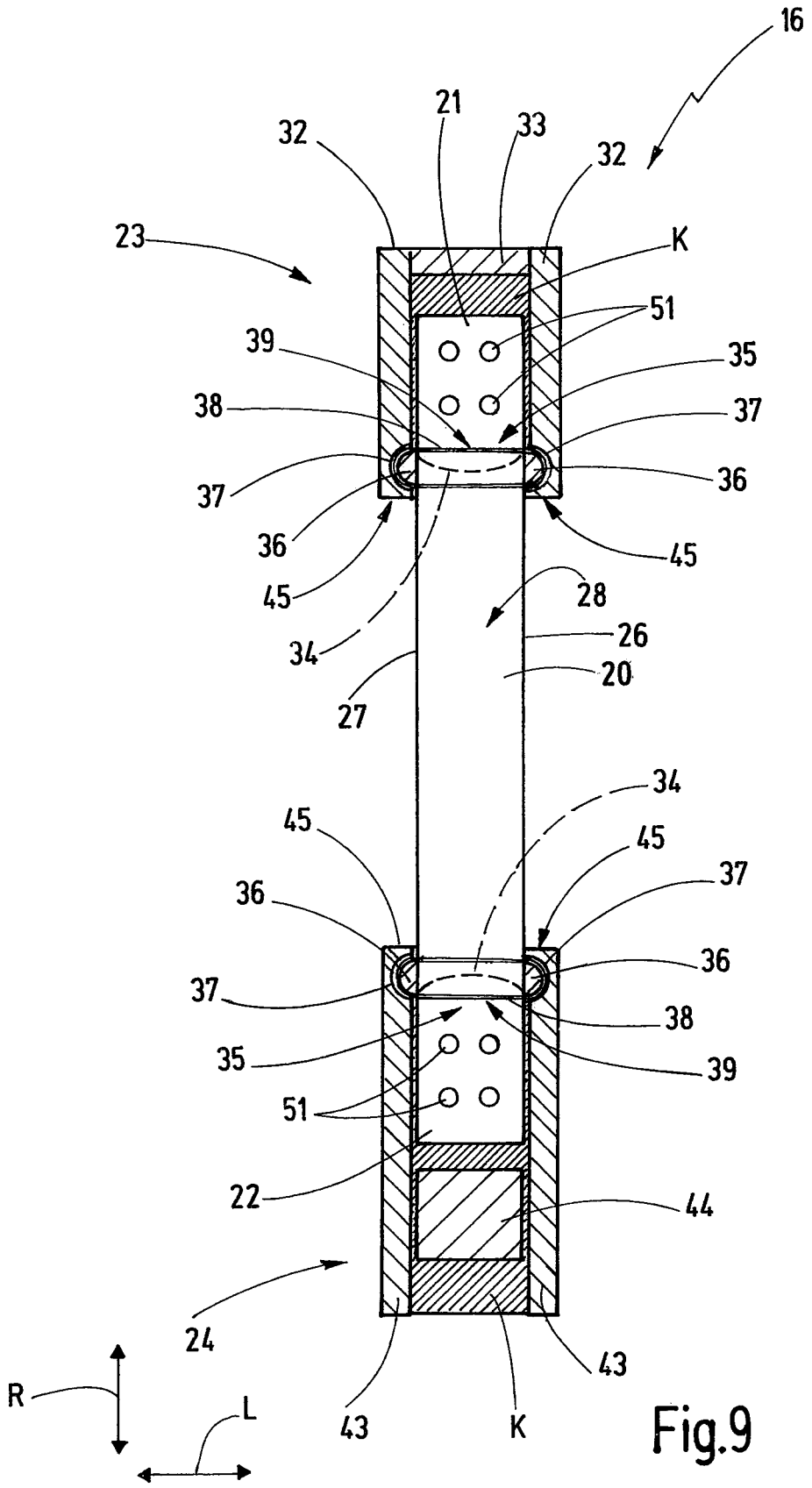

In addition or as an alternative to the separate spacers 50, one or multiple slats 20 can comprise spacer studs 51 projecting on one lateral surface or both lateral surfaces 28. The spacer studs 51 are arranged in the region of the top end 21 or the bottom end 22 of a slat 20 (FIG. 9). By means of the spacer studs 51 a minimum distance is defined between two directly adjacent slats 20. A section of a slat 20 having a spacer stud 51 is illustrated in FIG. 5. The spacer stud 51 can be formed by means of an embossing, such that the spacer stud 51 projects on one lateral surface 28, whereas a depression 52 is formed on the opposite lateral surface 28. The depression 52 or spacer stud 51 can thereby comprise a conical ring part 53, the center of which forms a central projection 54. The central projection 54 is offset compared with the surface of the conical ring part 53.

Compared with the embodiments according to the invention according to FIGS. 7-9, FIG. 6 shows a reed 16 according to the prior art. The plate parts 32, 43, the cover part 33 and the reinforcement rod 44 are made of metallic material and steel according to the example. It is shown that particularly in very wide reeds 16 in transverse direction Q a warping of the holding shafts 23, 24 occurs, as illustrated in FIGS. 3-4. The plate parts 32, 43 consist of steel in the prior art and are usually not ideally straight in transverse direction Q. During manufacturing of the holding shafts 23, 24 and particularly during manufacturing of the connection with adhesive K, the plate parts 32, 43 are clamped in a device and thereby orientated substantially straight in transverse direction Q. In doing so, inner stresses are created in the plate parts 32, 43. These inner stresses result in curves, warpings and deformations of the holding shafts 23, 24 upon removing the holding shafts 23, 24 from the device after hardening of the adhesive K. As a result the slats 20 of reed 16 are no longer ideally orientated in transverse direction Q. If slats 20 are brought into abutment against a plane spanned by transverse direction Q and extension direction R, not all of the front edges 26 contact this plane, but some of the front edges 26 are arranged with distance from this plane. A reed 16 warped in such a manner is undesired.

This warping is avoided according to the invention, in that the plate parts 32, 43 are made of fiber-reinforced composite material and are already substantially ideally orientated in a straight line in transverse direction Q prior to the production of the adhesive bond.

Figure 6:
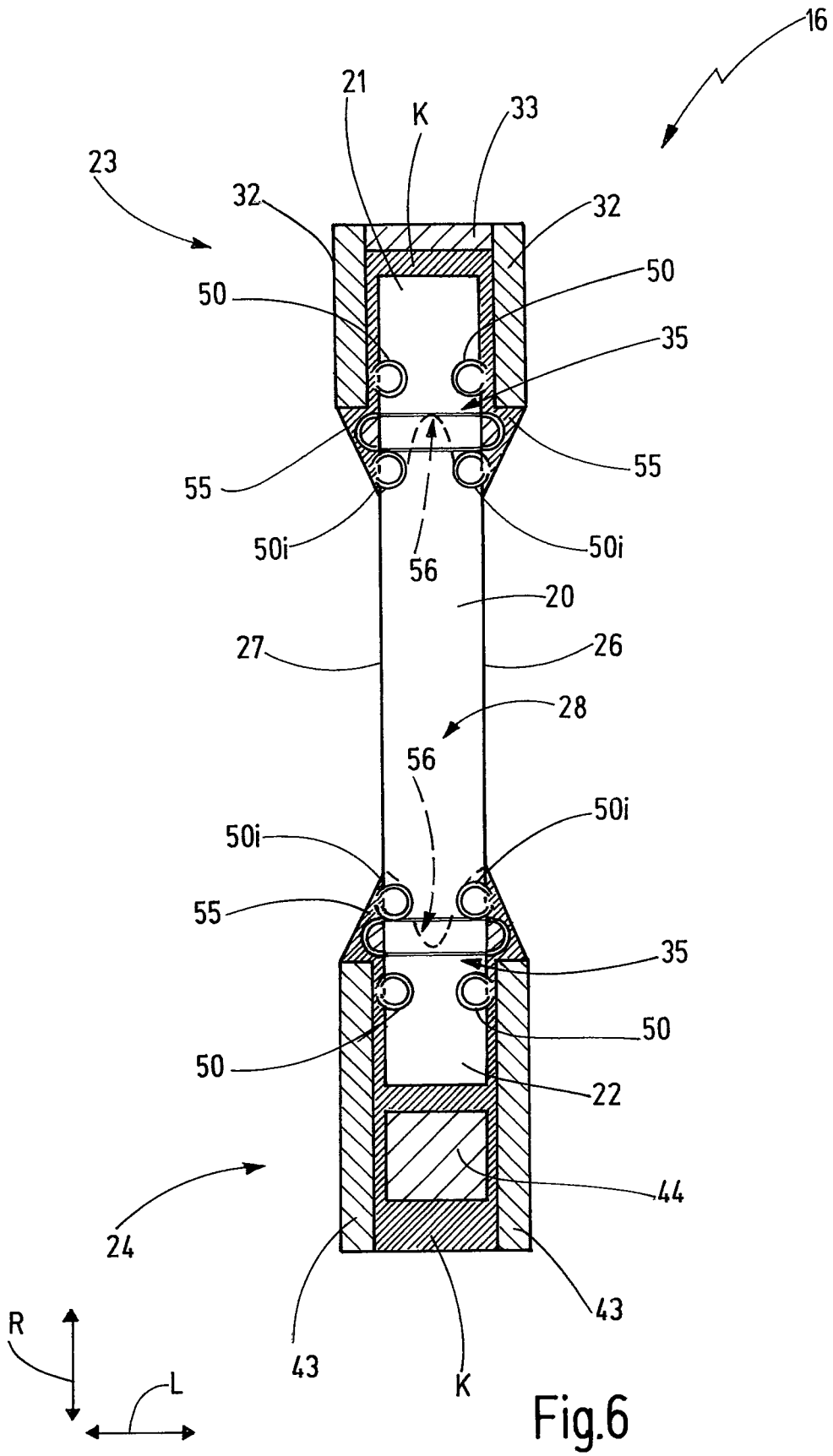

FIG. 6 also shows that the connection arrangements 35 are not arranged between the plate parts 32, 43 in the region of the holding shafts 23, 24, but are arranged in extension direction R adjacent to the plate parts 32, 43, according to the example adjacent to the respective face 45. There also additional inner spacers **50*i* are arranged configured as helical springs. Due to the connection arrangements 35 and inner spacers 50*i* arranged outside the holding shafts 23, 24, adhesive joints 55 are necessary adjacent to the faces 45 of the plate parts 32, 43 in order to cover and fixate the connection arrangements 35 or the inner spacers 50*i*. In this arrangement the adhesive K forms in the region of the connection arrangement 35 and the inner spacers 50*i* a pocket-like depression 56 during hardening in which fiber parts and other contamination may accumulate. If these drop on the woven fabric during stroke of the reed 16, the danger exists that contaminations are woven into the woven fabric and that the woven fabric becomes useless in this region. Due to the modified arrangement in the reeds according to the invention according to FIGS. 7-9, no formation of a pocket-like depression 56** occurs during hardening of adhesive K.

The cavity 37 with the adjoining web surface 46 can also be present in a plate part 32, 43, if no connection rod 36 or another component of the connection arrangement 35 is arranged there. In such a configuration the cavity 37 and the web surface 46 can serve to influence the flowing behavior and the shaping during hardening of adhesive K without the need that a component has to be located in the cavity.

The invention refers to a reed 16 comprising a multiplicity of slats 20 that are arranged with distance to one another in a transverse direction Q. Each slat 20 extends from a top end 21 to a bottom end 22. The top ends 21 are connected with two top plate parts 32 of a top holding shaft 23 by means of an adhesive bond with adhesive K. The bottom ends 22 of slats 20 are connected with two bottom plate parts 43 of a bottom holding shaft 24 by means of an adhesive bond with adhesive K. The plate parts 32, 43 are respectively manufactured of a fiber-reinforced composite material. Preferably the entire top holding shaft 23 as well as the entire bottom holding shaft 24 consist of parts that consist of a fiber-reinforced composite material.

LIST OF REFERENCE SIGNS

10 weaving machine
11 back rest

12 warp thread
13 heald frame
14 selvedge
15 weft thread
16 reed
20 slat
21 top end of slat
22 bottom end of slat
23 top holding shaft
24 bottom holding shaft
25 interstice
26 front edge of slat
27 back edge of slat
28 lateral surface of slat
32 top plate part
33 cover part
34 terminal surface of adhesive
35 connection arrangement
36 connection rod
37 cavity
38 binding element
39 loop
43 bottom plate part
44 reinforcement rod
45 face of a plate part
46 web surface
50 spacer
50*i* inner spacer
51 spacer stud
52 depression
53 conical ring part
54 central projection
55 adhesive joint
56 depression
h height of web surface
K adhesive
L longitudinal direction
Q transverse direction
R extension direction

The invention claimed is:

1. A reed (16), comprising:

multiple slats (20) that extend in an extension direction (R) between a top end (21) and an opposite bottom end (22) and that extend in a longitudinal direction (L) orthogonal to the extension direction (R) between front and back edges, wherein the slats (20) are spaced apart with respect to one another in a transverse direction (Q) that is oriented orthogonal to the extension direction (R) and the longitudinal direction (L);

wherein the top end (21) of each slat (20) is positioned in a top holding shaft (23) and wherein the bottom end (22) of each slat (20) is positioned in a bottom holding shaft (24), wherein gaps are formed between the front and back edges of the top end of each slat and the top holding shaft and between the front and back edges of the bottom end of each slat and the bottom holding shaft such that the front and back edges of the top and bottom ends of each slat are spaced from the respective top and bottom holding shafts, wherein the gaps are filled with an adhesive (K) to bond the top and bottom ends of each slat to the respective top and bottom holding shafts;

wherein each of the top and bottom holding shafts (23, 24) comprise two plate parts (32, 43) extending in the transverse direction (Q) that are arranged opposite each other in the longitudinal direction (L) and that are spaced from the respective front and back edges of the top and bottom ends (21, 22) of the slats by the adhesive-filled gaps;

wherein each of the plate parts (32, 43) are made of a fiber-reinforced composite material.

2. The reed (16) according to claim 1, wherein the plate parts (32, 43) extend continuously in the transverse direction (Q) along each of the slats (20).

3. The reed (16) according to claim 1, wherein the top holding shaft (23) comprises a cover part (33) that is arranged adjacent to the top ends (21) of the slats (20) in the extension direction (R) and that is connected by an adhesive bond with the top ends (21) of the slats (20) and the plate parts (32) of the top holding shaft (23).

4. The reed (16) according to claim 3, wherein the cover part (33) is made of a fiber-reinforced composite material.

5. The reed (16) according to claim 3, wherein the cover part (33) extends in the transverse direction (Q) continuously along each of the slats (20).

6. The reed (16) according to claim 1, wherein the bottom holding shaft (24) comprises a reinforcement rod (44) that is arranged adjacent to the bottom ends (22) of the slats (20) in the extension direction (R) and that is connected by an adhesive bond with the bottom ends (22) of the slats (20) and the plate parts (43) of the bottom holding shaft (24).

7. The reed (16) according to claim 6, wherein the reinforcement rod (44) is made of a fiber-reinforced composite material.

8. The reed (16) according to claim 6, wherein the reinforcement rod (44) extends continuously along each of the slats (20).

9. The reed (16) according to claim 1, wherein the slats (20) are arranged between two connection rods (36) extending in the transverse direction (Q) in a region of the top holding shaft (23) and/or in a region of the bottom holding shaft (24) respectively, wherein the connection rods (36) are connected with one another using a bendable binding element (38) that forms multiple loops (39), wherein each loop (39) extends around the connection rods (36) and between two directly adjacent slats (20).

10. The reed (16) according to claim 9, wherein each connection rod (36) is arranged between the slats (20) and a plate part (32, 43) of the top holding shaft (23) or the bottom holding shaft (24).

11. The reed (16) according to claim 10, wherein the plate parts (32, 43) of the top holding shaft (23) and/or the bottom holding shaft (24) comprise a cavity (37) extending in the transverse direction (Q) for location of an adjacent connection rod (36) therein.

12. The reed (16) according to claim 11, wherein a web surface (46) is present between the cavity (37) and an adjacent end of the plate part (32, 43) facing the slats, the height (H) of which parallel to the extension direction (R) is at most 3 mm.

13. The reed (16) according to claim 1, wherein at least one spacer (50) is present in a region of the top holding shaft (23) and/or in a region of the bottom holding shaft (24) that comprises multiple spacer elements that project into one interstice between two directly adjacent slats (20) respectively.

14. The reed (16) according to claim 13, wherein the at least one spacer (50) is arranged between the plate parts (32, 43) of the top holding shaft (23) or the bottom holding shaft (24).

15. The reed (16) according to claim 1, wherein individual ones of the slats (20) comprise spacer studs (51) projecting in the transverse direction (Q) that are arranged in a region of the top holding shaft (23) and/or the bottom holding shaft (24).

* * * * *